US005482295A

United States Patent [19]

Phelan

[11] Patent Number: 5,482,295

[45] Date of Patent: Jan. 9, 1996

[54] ROUND ROBIN DRAWING GAME BOARD

[76] Inventor: John J. Phelan, 109 Jeanette Ave., Inwood, N.Y. 11696

[21] Appl. No.: 438,105

[22] Filed: May 8, 1995

[51] Int. Cl.[6] ..... A63F 9/00

[52] U.S. Cl. ..... 273/459; 434/85; 434/408

[58] Field of Search ..... 273/459, DIG. 30, 273/240; 434/85, 90, 408, 410–414

[56] References Cited

U.S. PATENT DOCUMENTS

| | | | |
|---|---|---|---|
| 2,323,521 | 7/1943 | De Journette | 434/85 |
| 2,782,530 | 2/1957 | Larroca | 273/240 X |
| 2,818,662 | 1/1958 | Payne et al. | 434/410 |
| 3,434,718 | 3/1969 | Estrin et al. | 273/240 |
| 3,608,206 | 9/1972 | Knott | 434/410 X |
| 3,863,386 | 2/1975 | Kinberg | 46/135 R |
| 4,315,628 | 2/1982 | Balash et al. | 273/296 |
| 4,746,123 | 5/1988 | Skirvin | 273/153 R |
| 5,046,985 | 9/1991 | Cearfoss | 446/321 |
| 5,178,574 | 1/1993 | Evoy | 446/372 |
| 5,304,064 | 4/1994 | Atkinson | 434/85 |

FOREIGN PATENT DOCUMENTS

| | | | |
|---|---|---|---|
| 3119473 | 12/1982 | Germany | 273/240 |

*Primary Examiner*—Paul E. Shapiro
*Attorney, Agent, or Firm*—Richard L. Miller

[57] ABSTRACT

A drawing game board comprising a cover board which is fastened to a drawing board by mating hook and loop pile fastener material. The surface of the drawing board which is hidden by the cover board is made of erasable marker board. The cover board has six doors, which, when opened, reveal portions of the erasable marker board underneath. Drawing game boards are distributed to each of six players. Each player draws part of a body on his drawing board and then passes his board on to the next participant who will then draw the next body part without being able to see what the first participant drew. Thus in round robin fashion the participants will draw an entire body, and, at the end of the game, the drawings will be displayed in full for a few laughs. This game is designed to instruct young children in drawing the parts of the human body while amusing them.

4 Claims, 1 Drawing Sheet

FIG. 1
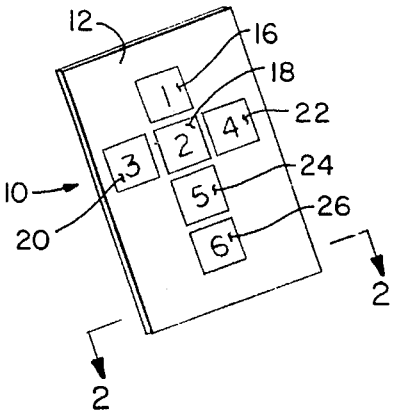
FIG. 2
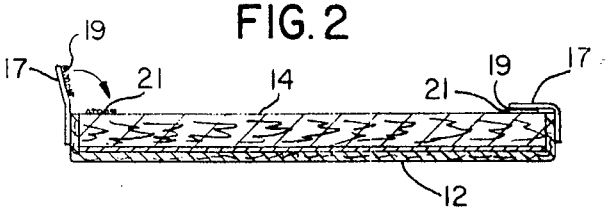
FIG. 3
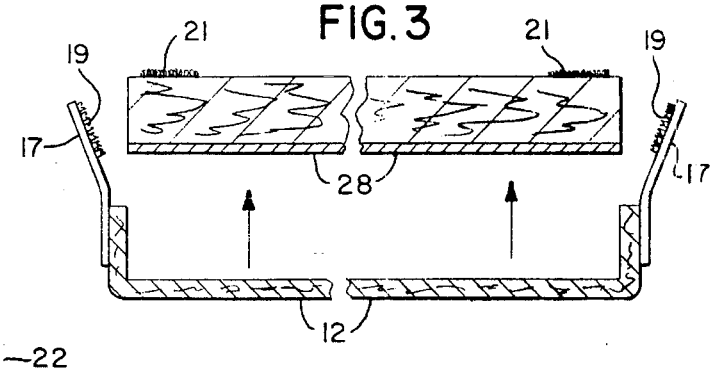
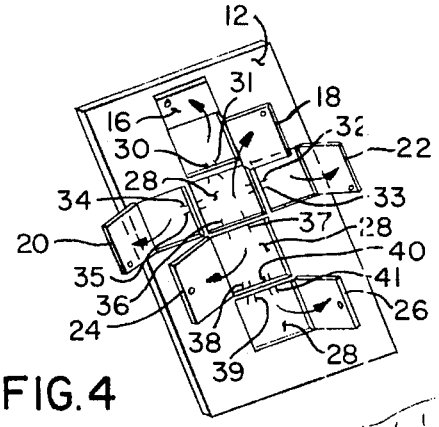
FIG. 4
FIG. 5
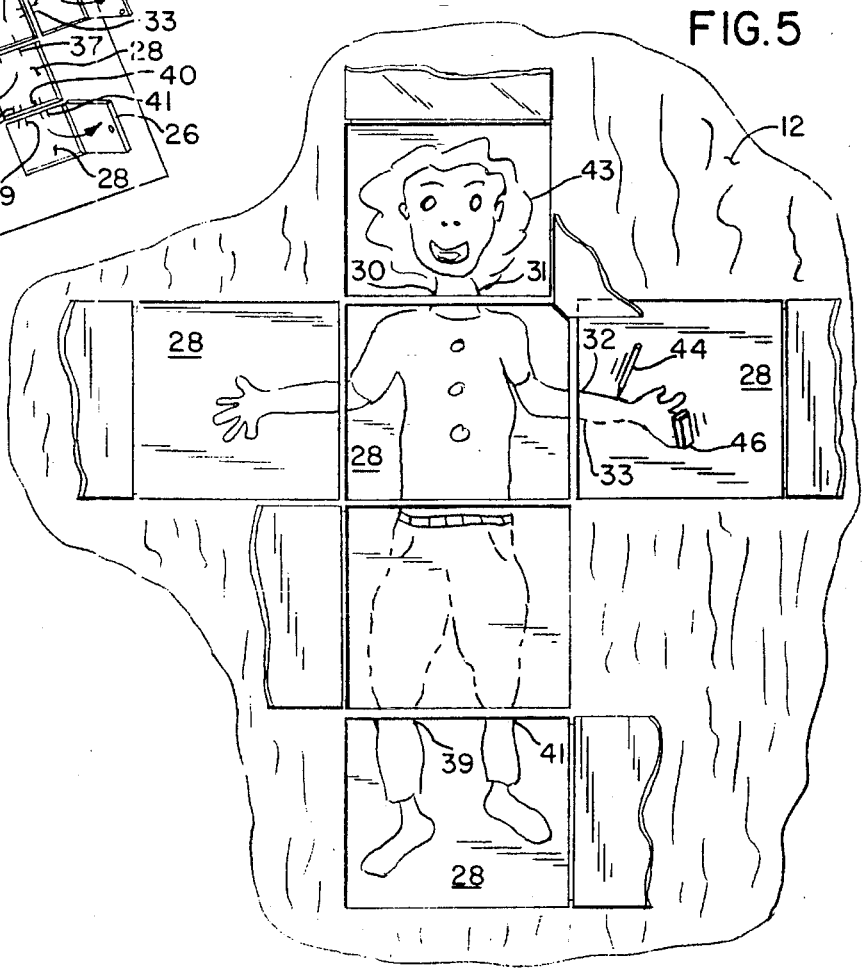

ROUND ROBIN DRAWING GAME BOARD

BACKGROUND OF THE INVENTION

The instant invention relates to games in general and more specifically to a game board for a drawing game in which each participant draws part of a body on his drawing board and then passes his board on to the next participant who will then draw the next body part without being able to see what the first participant drew. Thus in round robin fashion the participants will draw an entire body, and, at the end of the game, the drawings will be displayed in full for a few laughs. This game is designed to instruct young children in drawing the parts of the human body while amusing them.

DESCRIPTION OF RELATED ART

Many games and activities have been designed for young children to provide instruction for them while at the same time amusing them. A survey of the background art does not disclose any patents which are directly related to Applicant's invention but the following patents suggest certain aspects of applicant's invention.

For example, U.S. Pat. No. 3,863,386 to Kinberg describes a doll having a face on which various features can be represented by use of a stylus or the like. After representing the features, they can be easily erased. No actual game is involved, and no features are drawn but those of the face.

U.S. Pat. No. 4,315,628 to Balash et. al. provides a card game for amusement requiring active physical participation of the players for the purpose of exercising the bodies of the participants. No actual drawing is involved.

U.S. Pat. No. 4,746,123 to Skirvin discloses a method for scrambling illustrations to form the basis of a puzzle drawing game for the entertainment and enjoyment of those who like solving puzzles and who like drawing. This is not, of course, a round robin type game in which each participant draws part of a human body.

U.S. Pat. No. 5,046,985 to Cearfoss discloses a doll having a permanently imprinted doll face on a flap overlying a blank face plate. When the flap in a down position, the doll is played with in a conventional manner. When the flap is raised, the plate is revealed and the child can draw face designs on the plate. Again, this is not a round robin type game in which each participant draws part of a human body.

U.S. Pat. No. 5,178,574 to Evoy discloses an article, such as a stuffed toy, having one or more folds of material on the surface, adjacent to a feature or features, the folds being movable to alternate positions to vary the appearance of a feature. But this is not a round robin type drawing game for the amusement and instruction of young children.

None of these inventions provides a round robin type drawing game for instructing young children in the parts of the body and for amusing them at the same time.

Accordingly, the above mentioned lack of a suitable drawing game for young children to instruct them in the parts of the human body is obviated by the present invention which provides a drawing board for a children's game designed to instruct them in the parts of the human body while at the same time amusing them. This is a game for six participants who are seated in a circle. The game consists of an upper board (the cover board) which is fastened to a lower board (the drawing board) by mating hook and loop pile fastener material. This combination of the upper and lower boards is referred to as the composite game board. The surface of the drawing board which is hidden by the cover board to is made of erasable marker board. Thus after a game is played, the drawings can be easily erased before the next game is played. The cover board has six hingeable panels or doors, which, when opened, reveal portions of the erasable marker board underneath. There are six composite game boards, one for each player. Each player opens the first door of the cover board which discloses two guide lines at the bottom representing a portion of the neck. Each player draws a head to connect with the neck guide lines. When each of the players has finished drawing a head, the players close the doors thus hiding the heads which they have just drawn. Then each player passes his composite game board on to the next player in the circle. Now each player opens the second door which discloses two short guide lines representing a portion of the neck at the top, two short guide lines at the left and right sides representing portions of the left and right arms, and a pair of two short guide lines at the bottom representing portions of two knees. The players each now draw a torso so as to connect up with the preprinted guide lines.

The players then each close their second door and pass their composite game boards on to the next participant in the circle. The players continue in this fashion until the entire body has been drawn. Then each player unfastens the mating hook and loop pile fastener material holding the cover board to the drawing board and holds up the drawing board with its completed picture for observation by the other players.

When the instant invention is compared with the card game disclosed by the Balash et. ac. patent (which might be considered the closest background art in that it is a game involving the various parts of the human body), it can be seen that the invention disclosed by the Balash patent is not a drawing game, and lacks that element of delight at the end when each player of the instant game raises his completed picture for observation by the other players.

It is therefore an object of the present invention to provide a drawing game which can be used to instruct young children in the parts of the human body.

A second object of this invention is to provide a drawing game with an element of suspense and surprise in that the participants only see their completed creations at the end of the game.

A third object of this invention is to provide a game which is played in round robin fashion thus promoting friendship and Gun for young children.

A fourth object of this invention is to provide a drawing game which is designed to develop a child's drawing ability while he is having fun.

Further scope of applicability of the present invention will become apparent from the detailed description given hereafter. However, it should be understood that the drawings and the detailed description, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a diagrammatic perspective view of the instant invention.

FIG. 2 is a diagrammatic cross sectional view taken on line 2—2 of FIG. 1.

FIG. 3 is an enlarged diagrammatic exploded view with the front face containing the hingeable panels or doors exploded therefrom.

FIG. 4 is a diagrammatic perspective view illustrating typically the hingeable panels or doors in various positions.

FIG. 5 is an enlarged diagrammatic planned view of the instant invention with parts broken away with a figure partially drawn thereon.

DESCRIPTION OF PREFERRED EMBODIMENT

Referring to the various drawings, the Round Robin Drawing Game Board or Composite Board is generally shown as numeral 10 in FIG. 1. The Composite Board consists of a cover board 12 and a drawing board (hidden in FIG. 1 but shown as 14 in FIG. 2). The cover board has six doors, which, to avoid confusion with the reference numerals, are here listed as one through six 16, 18, 20 22, 24, 26. Doors one, two, five, and six (shown as numerals 16, 18, 24, 26) are arranged one below the other with door one at the top and door six at the bottom. Doors three and four (shown as numerals 20 and 22) are to the left and right respectively of door two (shown as numeral 18).

As shown in FIG. 2, the lower surface of the drawing board 14 14 has straps 17 attached to each of its four corners. Each strap 17 has a patch of mating hook and loop pile fastener material 19 affixed to its inner surface for attaching to a corresponding patch of mating hook and loop pile fastener material 21 attached to each of the four corners of the upper surface of the cover board 12. In this way, cover board 12 is removably attached to the drawing board 14 by the corresponding patches of mating hook and loop pile fastener material at the four corners of the upper surface of the cover board 12 and the inner surfaces of the straps 17 attached to the four corners of the lower surface of the drawing board 14.

As is shown in FIG. 3, on the upper surface of the drawing board is a sheet of erasable marker board 28 which is unremovably attached to stiff backing material 29. As best seen in FIG. 4, on the erasable marker board, there are a series of short guide lines indicating how the various parts of the body to be drawn are to be linked up with adjacent parts of the body which are yet to be drawn (or have already been drawn) by the various game players. When the cover board 12 is attached to the drawing board 14 and door number one 16 is opened, the upper portions of the guide lines 30, 31 for the neck can be seen. The lower portions of these guide lines 30, 31 can be seen when door two 18 is opened. These guide lines are a small portion of the neck that is to be drawn as part of drawing the head when door number one is opened, and are a small part of the neck that is to be drawn as part of drawing the torso of the body when door number two 18 is opened. Similar guide lines appear on the drawing board at the junctions of other doors to assist the players in drawing the other body parts. For example, the guide lines 34, 35 for drawing the right arm appear at the junction of doors three and two; the guide lines 32, 33 for drawing the left arm appear at the junction of doors two and four; the guide lines 36, 37 for drawing the waist and thighs appear at the junction of doors two and five; the guide lines 38, 39 for drawing the left knee and lower left leg and the guide lines 40, 41 for drawing the right knee and lower right leg appear at the junction of doors five and six.

FIG. 4 shows how the various doors open and close to reveal the portions of the drawing board on which portions of the body are to be drawn. If the material of the cover board is wood the doors will be joined to the cover board by hinges. If the cover board is made of a softer material like cardboard or soft plastic, the doors will be bendable at their junction with the cover board.

FIG. 5 is an enlarged diagrammatic planned view of the instant invention with the doors of the cover board 12 folded back to show a FIG. 43 partially drawn on the drawing board, with drawing implements 44, and erasing implement 46.

CONCLUSIONS RAMIFICATIONS, AND SCOPE OF INVENTION

From the foregoing, it will be seen that I have provided a Round Robin Drawing Game Board for a game in which the participants in round robin fashion contribute their version of a portion of a human body to the overall picture of the body.

Thus the reader will see that my invention supplies a long felt need for a drawing game which can be used to teach young children how to draw and to instruct them in the various parts of the human body and which is fun to play as well. There are many variations of this Round Robin Drawing Game Board which can be made by those skilled in the art without departing from the inventive concepts expressed herein. Accordingly, the scope of my invention should be determined not by the embodiments described, but by the appended claims and their legal equivalents.

The invention claimed is:

1. A round robin drawing game board for playing a game in which each player in round robin fashion draws his version of a portion of the human body, said game board comprising:

(a) a rectangular cover board having an upper surface and a lower surface, said cover board having a plurality of doors opening on its upper surface, each door having an upper edge, a lower edge , and an edge whereby the door may be opened, said door being opened by pulling outward on the openable edge thereof;

(b) pieces of mating hook and loop pile fastener material attached to the upper surface of the cover board and extending in an outward and downwardly direction therefrom;

(c) a rectangular drawing board having an upper surface and a lower surface, wherein the upper surface of the drawing board comprises erasable marker board, the lower surface has four patches of mating hook and loop pile fastener material positioned so as to be attachable to the pieces of mating hook and loop fastener material extending outward and downward the upper surface of the cover board; whereby when the cover board is attached to the drawing board by the pieces of mating hook and loop pile fastener material, and the plurality of doors on the upper surface of the cover board are opened portions of the erasable marker board surface of the drawing board are exposed.

2. The round robin drawing game board of claim 1 wherein the number of doors on the upper surface of the cover board is six.

3. The round robin drawing game board of claim 2 wherein four of the six doors are positioned one under the other thus forming a sequence of four doors from a top door to a bottom door, and the other two doors are positioned to the left and to the right of the door below the top door.

4. The round robin drawing game board of claim 3 wherein the marker board surface of the cover board has a plurality of markings thereon for assisting a player in properly connecting the body part he is drawing with other body parts yet to be drawn or already drawn.

* * * * *